US006748612B1

(12) United States Patent
Cerne et al.

(10) Patent No.: US 6,748,612 B1
(45) Date of Patent: Jun. 15, 2004

(54) TRANSFER APPARATUS

(76) Inventors: Kathleen M. Cerne, 1107 E. 22nd St., Pittsburg, KS (US) 66762; Harry E. Cerne, 307 S. 253rd St., Pittsburg, KS (US) 66762

( * ) Notice: Subject to any disclaimer, the term of this patent is extended or adjusted under 35 U.S.C. 154(b) by 0 days.

(21) Appl. No.: 09/714,809

(22) Filed: Nov. 16, 2000

(51) Int. Cl.[7] ..... A61G 7/08
(52) U.S. Cl. ..... 5/81.1 HR; 5/81.1 S
(58) Field of Search ..... 5/81.1 R, 81.1 HS; 280/304.1; 297/153, 155, DIG. 4; 108/49, 44

(56) References Cited

U.S. PATENT DOCUMENTS

| | | | | | |
|---|---|---|---|---|---|
| 3,052,894 | A | | 9/1962 | Bigger | 5/81 |
| 3,901,527 | A | * | 8/1975 | Danziger et al. | 280/638 |
| 4,155,588 | A | * | 5/1979 | Danziger et al. | 297/115 |
| 4,288,124 | A | * | 9/1981 | Hamilton | 297/233 |
| 4,987,621 | A | | 1/1991 | Brantman | 5/81 R |
| 5,026,114 | A | * | 6/1991 | Miller | 108/49 |
| 5,060,960 | A | | 10/1991 | Branscumb et al. | 280/250.1 |
| 5,067,188 | A | | 11/1991 | Brantman | 5/81 R |
| 5,152,016 | A | | 10/1992 | Becker | 5/81.1 |
| 5,193,233 | A | | 3/1993 | Miller | 5/81.1 |
| 5,207,549 | A | | 5/1993 | Riva | 414/340 |
| 5,735,002 | A | | 4/1998 | Kistner | 5/81.1 HS |
| 5,802,632 | A | * | 9/1998 | Campbell | 198/321 |
| 5,947,501 | A | | 9/1999 | Osborn | 280/304.1 |

* cited by examiner

*Primary Examiner*—Teri Pham Luu
*Assistant Examiner*—Fredrick Conley
(74) *Attorney, Agent, or Firm*—Shook, Hardy & Bacon LLP

(57) ABSTRACT

A transfer apparatus for aiding in the transfer of persons confined to a wheelchair from the wheelchair to another support surface (e.g., beds, toilets, commodes, seated showers, household furniture, etc.) which is adapted to be used with a wheelchair having a frame and a pair of rear tires disposed on an exterior of the frame. The apparatus includes a rectangular body defined by a pair of lateral edges, a pair of longitudinal edges, a top surface and a bottom surface. Proximate the first lateral edge is positioned a first securing component and proximate the second lateral edge is positioned a second securing component, both securing components for securing the body to the wheelchair. In use, the first securing component is received in an armrest housing and the second securing component is received between one of the rear tires and the frame of the wheelchair.

11 Claims, 1 Drawing Sheet

TRANSFER APPARATUS

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

The present invention relates to an apparatus to aid persons in transferring from one support surface to another. More specifically, this invention relates to an apparatus for facilitating the assisted or unassisted transfer of a person between a wheelchair and a second support surface, the apparatus being secured to the wheelchair in more than one location to minimize the risk of slippage during use.

Various apparatus are known for aiding in the transfer of a person between a wheelchair and another support surface. For instance, U.S. Pat. No. 5,947,501 teaches a combined transfer apparatus and armrest. The transfer apparatus of the '501 patent is reconfigurable between a stored position in which the transfer apparatus extends along one side of the wheelchair seating surface and an active position in which the apparatus extends from the wheelchair seating surface to a second support surface, such as a chair or bed. The transfer apparatus is attached to the wheelchair by a coupling that is both rotatable and slidable. The slidable nature of the coupling permits the apparatus to be alternated between its stored and active positions. The rotatable nature of the coupling permits positioning of the transfer apparatus in the desired direction.

The apparatus of the '501 patent suffers from a number of drawbacks. First, a wheelchair utilizing the apparatus must be equipped with a specially configured armrest and apparatus guide system. As such, the apparatus is complex to assemble and is not easily adaptable for use on existing wheelchairs. Second, the apparatus is secured to the wheelchair at only a single location. As such, slippage may occur during use. The risk of slippage is further enhanced by the use of a rotatable coupling, which may cause the apparatus to rotate, during use, away from the desired second support surface to or from which a person is being transferred.

Each of U.S. Pat. Nos. 4,155,588 and 5,060,960 also teaches acombination armrest or side panel and transfer apparatus. The armrest of the '588 patent is hingedly attached and folds out into a transfer apparatus which extends away from the seat of the wheelchair. Similarly, in the device disclosed in the '960 patent, the side panels of the wheelchair fold out, thereby forming a transfer apparatus. Each transfer apparatus remains attached along the horizontal edge of its wheelchair during transfer. While each apparatus may offer a more secured transfer than that of the '501 patent, neither apparatus is easily adaptable for use on existing wheelchairs.

Accordingly, there remains a need in the transfer apparatus industry for a transfer apparatus which is sufficiently secure during transfer that the user does not have to worry about slippage and which is easily adaptable to existing wheelchairs. Further, there remains a need for a transfer apparatus which is inexpensive to construct, easy to assemble and use, and which does not have to be specially configured to the chair of the user.

SUMMARY OF THE INVENTION

Accordingly, in one of its aspects, the present invention is to provide a transfer apparatus of quality construction which is secured to a wheelchair at more than one location to minimize the risk of slippage during use.

In another of its aspects, the invention provides a transfer apparatus which is easily adaptable to existing wheelchairs.

In a further aspect, the present invention provides a transfer apparatus which is inexpensive to construct and may be easily assembled and utilized.

According to the present invention, the foregoing and other aspects are achieved by a transfer apparatus for use in transferring persons confined to a wheelchair from the wheelchair to another support surface (e.g., beds, toilets, commodes, seated showers, household furniture, etc.). The transfer apparatus of the present invention is adapted for use with a wheelchair which has a frame and a pair of rear tires disposed on an exterior of the frame. The apparatus comprises a rectangular body defined by first and second lateral edges, first and second longitudinal edges, a top surface and a bottom surface. Proximate the first lateral edge is positioned a first securing component and proximate the second lateral edge is positioned a second securing component, both securing components for securing the body to the wheelchair. The bottom surface of the body is substantially planar and the top surface includes a generally planar central portion and opposed outer portions, the outer portions tapering toward the first and second longitudinal edges respectively. The securing components are aligned with the central portion of the top surface and are in longitudinal alignment with respect to one another. In use, the second securing component is received between one of the rear tires and the frame of the wheelchair.

The present invention also provides a transfer apparatus for use with a conventional wheelchair having a frame, a pair of rear tires disposed on an exterior of the frame, and at least one removable armrest adapted to be received in an armrest housing. The apparatus comprises a body which includes first and second lateral edges, a top surface and a bottom surface, the bottom surface being substantially planar. The apparatus further comprises a first securing component for securing the body to the wheelchair, the first securing component being positioned proximate the first lateral edge of the body and extending substantially perpendicularly from the bottom surface thereof. When the armrest is removed from the wheelchair, the first securing component is received in the armrest housing. The apparatus further comprises a second securing component for securing the body to the wheelchair, the second securing component being positioned at the second lateral edge of the body. When the armrest is removed, the second securing component is received between one of the rear tires and the frame of the wheelchair. The body of the apparatus further includes an aperture disposed proximate the first lateral edge of the body such that the first securing component may be removably positioned within the aperture.

Additional aspects of invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means and instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are employed to indicate like parts in the various views.

DETAILED DESCRIPTION OF THE PREFERRED EMBODIMENT

The present invention is directed to an apparatus for facilitating assisted or unassisted transfer of a person between a wheelchair and a second support surface. The particular embodiments described herein are intended in all respects to be illustrative rather than restrictive. Alternative embodiments will become apparent to those skilled in the art to which the present invention pertains without departing from its scope.

Figure 2:
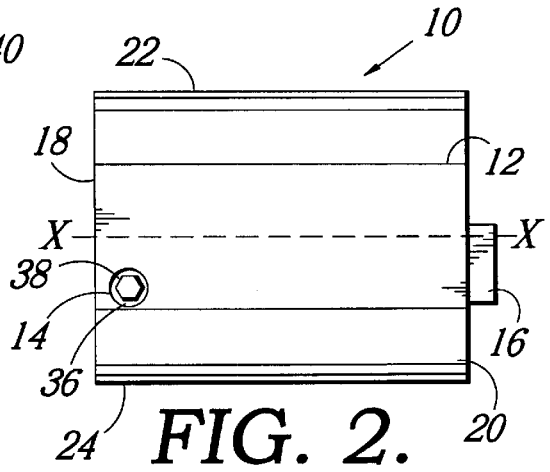
FIG. 2 is a top elevational view of a preferred embodiment of the present invention.
Figure 3:
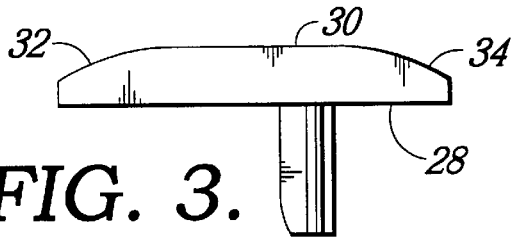
FIG. 3 is a left side view of the embodiment of FIG. 2.

Referring to the drawings in greater detail and initially to FIG. 2 in particular, where like reference numerals identify like elements in the various views, a transfer apparatus manifesting aspects of the present invention is illustrated therein and is designated generally by the numeral 10. Transfer apparatus 10 includes a body 12, a first securing component 14 and a second securing component 16. Body 12 is preferably rectangular in shape and is defined by first and second lateral edges 18, 20, first and second longitudinal edges 22, 24, a top surface 26 and a bottom surface 28. It will be understood and appreciated, however, that a transfer apparatus of any shape comprising the features of the present invention is contemplated to be within its scope. Body 12 preferably is formed of wood. However, it will be understood that in the present invention a body formed of any suitable material, including but not limited to plastics, is contemplated as within its scope.

The bottom surface 28 of body 12 is generally planar. The top surface 26, however, is beveled in nature and has a planar central portion 30 and first and second outer portions 32, 34 which taper toward opposing longitudinal edges 22 and 24 respectively. In the preferred embodiment of the present invention, body 12 is a square, with each lateral edge 18, 20 and each longitudinal edge 22, 24 being about fifteen inches in length. Planar central portion 30 is preferably about ¾ inch thick and the first and second longitudinal edges 22, 24 are preferably about ¼ inch thick. Thus, top surface 26 tapers gradually and evenly from ¾ inch to ¼ inch over the length of outer portions 32 and 34. In the preferred fifteen inch square embodiment, the planar central portion 30 extends across the middle seven inches of top surface 26 resulting in first and second outer portions 32, 34 which are about four inches in length. Accordingly, the height of body 12 gradually decreases toward each longitudinal edge 22, 24, by ½ inch over a lateral distance of four inches. It will be understood and appreciated, however, that a transfer apparatus of varying heights and dimensions is contemplated to be within the scope of the present invention.

First securing component 14 is located proximate first lateral edge 18 of body 12, preferably within planar central portion 30. An aperture 36 is positioned proximate first lateral edge 18 at the location in which first securing component 14 will be located, as more fully described below. Aperture 36 has a recess 38 at the mouth thereof. Upon assembly, the combination of aperture 36 and recess 38 will house first securing component 14, as more fully described below.

First securing component 14 is in the form of a post, preferably a bolt, with an enlarged head portion. In the preferred embodiment, first securing component 14 is a ½ inch bolt which is about 3½ inches in length. Upon assembly, first securing component 14 is inserted into aperture 36, the enlarged head resting within recess 38 thus preventing the post or bolt from passing completely through aperture 36. Recess 38 must be large enough to house the entire enlarged head portion of the bolt such that the head portion does not extend above the top surface 26 of the body 12, but rather is imbedded at least to be flush with top surface 26. In the preferred embodiment, the enlarged head portion of first securing component 14 is machined to about ¼ inch thick. Thus, recess 38 must extend at least ¼ inch below the top surface 26 of body 12. First securing component 14 is removable and when assembled on body 12, extends substantially perpendicularly beneath the bottom surface 28 thereof. The portion of first securing component 14 which passes through aperture 36 will be inserted into the armrest housing of a wheelchair to secure the apparatus 10 in place, as more fully described below.

Figure 4:
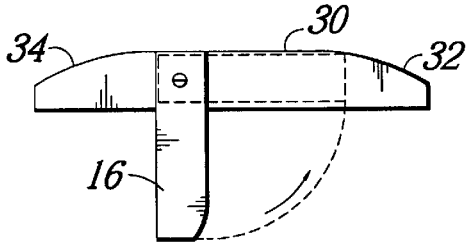
FIG. 4 is a right side view of the embodiment of FIG. 2.
Figure 5:
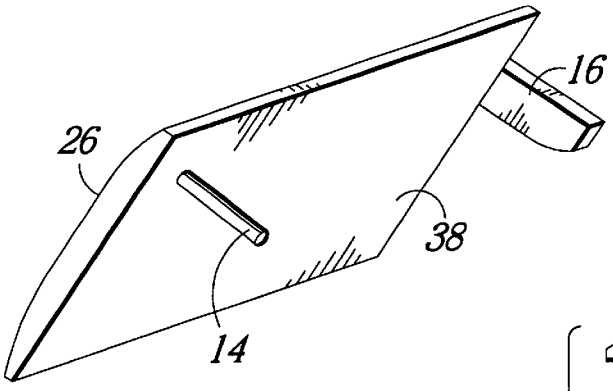
FIG. 5 is a bottom perspective view of the apparatus constructed in accordance with a preferred embodiment of the invention.
Figure 6:
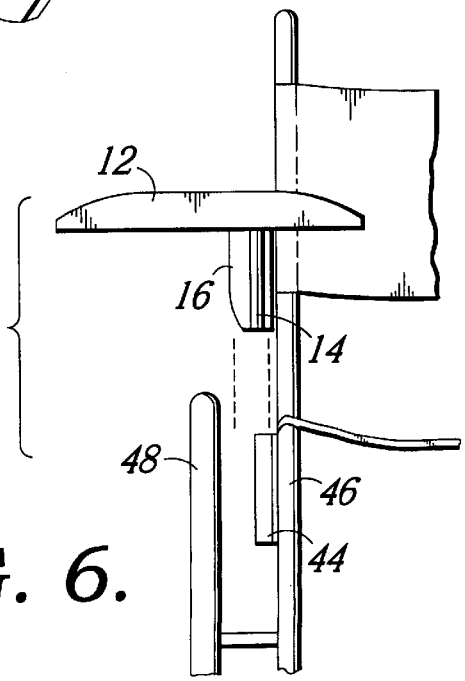
FIG.6 is a fragmented front view illustrating the attachment of the apparatus to a wheelchair.

Second securing component 16 is located at the second lateral edge 20 of body 12. Second securing component 16 is in the form of a block which is secured to the outer surface of second lateral edge 20 such that block 16 is perpendicular to planar central portion 30 and bottom surface 28. In the preferred embodiment, second securing component 16 is formed of a block of wood having a length of about 3 and ⅞ inches, a width of about 1 and ⅜ inches and a thickness of about ⅞ inch. The top edge of the block 16 aligns with the planar central portion 30 of the top surface 26 of the body 12 such that the block extends below the bottom surface 28 of the body 12 but does not extend above the top surface thereof. Second securing component 16 may be secured to body 12 in any conventional manner, e.g., screws, nails, or the like. In one embodiment, second securing component 16 may be pivotally connected to body 12 such that the second securing component may be alternated between an active position in which the component is perpendicular to the bottom surface 28 of the body 12 and a stored position in which the component is pivoted to lie fully adjacent second lateral edge 20, as illustrated in broken line in FIG. 4.

Second securing component 16 may be tapered at one of its lower corners to facilitate wedging between the rear tire and the frame of the wheelchair, as more fully described below. Most conventional battery powered wheelchairs include only one side from which mounting and dismounting the chair may take place with the use of a transfer apparatus. Which corner would be tapered depends upon whether the transfer apparatus 10 of the present invention is to be used with a left or right dismounting chair.

First and second securing components 14, 16 may be located at any point along lateral edges 18 and 20. However, it is preferred that both securing components be located within planar central portion 30 and offset from the central longitudinal axis, x, of the apparatus 10. Wherever the securing components 14, 16 are located, the components are preferably in longitudinal alignment with respect to one another.

Figure 1:
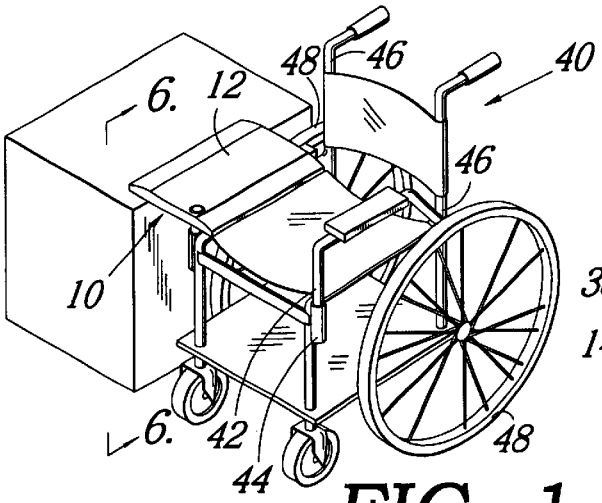
FIG. 1 is a perspective view of a transfer apparatus constructed in accordance with a preferred embodiment of the invention illustrating the apparatus of the present invention attached to a wheelchair.

FIG. 1 illustrates the transfer apparatus 10 of the present invention in its operational position. To use apparatus 10, a wheelchair 40 is placed immediately adjacent to the surface to which the occupant desires to be transferred, i.e., the receiving surface. The armrest of the wheelchair 42 which is closest to the receiving surface is removed exposing a tubular armrest housing 44. The occupant then tilts toward the opposite side of the wheelchair 40 while the second tapered longitudinal edge 24 of the apparatus is placed just underneath the occupant's thigh and buttocks. With the apparatus in this position, first securing component 14 is placed into the tubular armrest housing 44 located closest to the front of the wheelchair which previously had housed a securing pin from the armrest. Concurrently, the second securing component 16 is wedged between the frame 46 at the rear of the wheelchair 40 and the rear tire 48. The first tapered longitudinal edge 22 is placed upon the receiving surface. Thus, the occupant has a bridge between the two surfaces which enables him or her to move between the wheelchair 40 and the receiving surface more efficiently. It will be understood and appreciated that either the first securing component or the second securing component may be secured in place before the other, or the two may be secured concurrently.

To transfer between surfaces, the user mounts the apparatus with the aid of the second tapered longitudinal edge 24 and maneuvers via a scooting motion across the apparatus. Once the user has scooted past the planar central portion 30 of top surface 26, the first longitudinal edge which is tapered toward the receiving surface 22 aids the user in dismounting the board. As the apparatus 10 is secured to the wheelchair 40 in two locations which are longitudinally aligned with one another, the apparatus is not subject to slippage during movement. Further, in circumstances in which the receiving surface and the seating portion of the wheelchair are not at the same height level, the combination of the two longitudinally aligned securing points and the tapered edges create a "see-saw" effect which aids the user in transfers through a shift in weight or momentum.

Constructed and operated as previously described, this invention provides a transfer apparatus of quality construction which, as it is secured in two independent places, will not slip during use. Additionally, the tapered nature of the apparatus facilitates the transfer both by aiding the user in mounting and dismounting the apparatus and by shifting the weight of the user more efficiently when used between surfaces of varying heights. The present invention also provides a transfer apparatus which is easily adaptable to most battery powered wheelchairs currently on the market. The design of the present invention may be modified to fit any model battery powered or manual wheelchair, left or right dismount. In addition, the transfer apparatus of the present invention is inexpensive to construct and may be easily assembled and utilized. The apparatus of the present invention is portable and therefore consumers may use the board for mobility at home or work, as well as in hospital or rehabilitation settings.

In conclusion, the present invention is directed to an apparatus for facilitating transfer of a person between a wheelchair and a second support surface, the apparatus being secured to the wheelchair in more than one independent location to minimize the risk of slippage during use. The present invention has been described in relation to particular embodiments which are intended in all respects to be illustrative rather than restrictive.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Having thus described the invention, what is claimed is:

1. A transfer apparatus for use with a wheelchair, the wheelchair having a frame and a pair of rear tires disposed on an exterior of the frame, the apparatus comprising:

a rectangular body defined by first and second lateral edges, first and second longitudinal edges, a top surface and a bottom surface, wherein the first longitudinal edge is placed on a receiving surface to form a bridge between the receiving surface and a wheelchair;

a first securing component for securing said body to a wheelchair, said first securing component positioned proximate said first lateral edge of said body; and a second securing component for securing said body to a wheelchair, said second securing component positioned proximate said second lateral edge of said body, wherein said second securing component is adapted to be wedged between one of the rear tires and the frame of the wheelchair when said apparatus is in use.

2. The transfer apparatus as recited in claim 1, wherein said bottom surface is substantially planar, wherein said top surface includes a generally planar central portion and opposed outer portions, and wherein said outer portions are tapered toward said first and second longitudinal edges respectively.

3. The transfer apparatus as recited in claim 2, wherein said first and second securing components are aligned with said planar central portion of said top surface and are in longitudinal alignment with respect to one another.

4. The transfer apparatus as recited in claim 3, wherein said second securing component is pivotable between a first position in which said second securing component extends substantially perpendicularly from said body and a second position in which said second securing component is fully adjacent said second lateral edge of said body.

5. The transfer apparatus as recited in claim 1, wherein said first and second securing components are in longitudinal alignment with respect to one another.

6. A transfer apparatus for use with a wheelchair, the wheelchair having a frame, a pair of rear tires disposed on an exterior of the frame and at least one removable armrest adapted to be received in an armrest housing, the apparatus comprising:

a body, said body including first and second lateral edges, a top surface and a bottom surface, wherein said bottom surface is substantially planar;

a first securing component for securing said body to a wheelchair, wherein said first securing component is positioned proximate said first lateral edge of said body and extends substantially perpendicularly from said bottom surface thereof, and wherein said first securing component is adapted to be received in the armrest housing when the armrest is removed from a wheelchair; and a second securing component for securing s aid body to a wheelchair, wherein said second securing component is positioned at said second lateral edge of said body, and wherein said second securing component is adapted to be received between one of the rear tires and the frame of the wheelchair when the armrest is removed.

7. The transfer apparatus as recited in claim 6, further comprising first and second longitudinal edges, wherein at least a portion of said top surface is tapered outwardly toward each of said longitudinal edges.

8. The transfer apparatus as recited in claim 7, said body further including an aperture disposed proximate said first lateral edge of said body, wherein said first securing component is removably positioned within said aperture.

9. The transfer apparatus as recited in claim 8, said body further including a recess at a mouth of said aperture, wherein said first securing component is a bolt having an enlarged head, and wherein said enlarged head rests in said recess when said bolt is fully inserted in said aperture.

10. The transfer apparatus as recited in claim 8, wherein said second securing component is pivotable between a first position in which said s second securing component extends substantially perpendicularly from said body y a and a second position in which said second securing component is fully adjacent said second lateral edge of said body.

11. The transfer apparatus as recited in claim 6, wherein said firs and second securing components are in longitudinal alignment with respect to one another.

* * * * *